US008147030B2

(12) United States Patent
Harada

(10) Patent No.: US 8,147,030 B2
(45) Date of Patent: Apr. 3, 2012

(54) FLUID EJECTING APPARATUS

(75) Inventor: Koji Harada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 393 days.

(21) Appl. No.: 12/437,653

(22) Filed: May 8, 2009

(65) Prior Publication Data

US 2009/0278884 A1 Nov. 12, 2009

(30) Foreign Application Priority Data

May 9, 2008 (JP) ..... 2008-123224

(51) Int. Cl.
*B41J 2/165* (2006.01)

(52) U.S. Cl. ..... 347/29; 347/30

(58) Field of Classification Search ..... None
See application file for complete search history.

(56) References Cited

U.S. PATENT DOCUMENTS

| | | | | |
|---|---|---|---|---|
| 7,244,013 | B2 * | 7/2007 | Harada et al. | 347/29 |
| 2007/0165062 | A1 * | 7/2007 | Usui et al. | 347/29 |
| 2007/0252865 | A1 * | 11/2007 | Sakurai | 347/29 |

FOREIGN PATENT DOCUMENTS

| | | |
|---|---|---|
| JP | 2000-062201 | 2/2000 |
| JP | 3125478 U | 8/2006 |

* cited by examiner

*Primary Examiner* — Stephen Meier
*Assistant Examiner* — Tracey McMillion
(74) *Attorney, Agent, or Firm* — Workman Nydegger

(57) ABSTRACT

A fluid ejecting apparatus includes an ejection head having an ejection surface with a nozzle region and a capping device that contacts the ejection surface. The capping device includes first and second contact members held by a cap body. When the first contact member contacts the ejection surface, a surface of the first contact member surrounds the nozzle region. The second contact member is formed in a closed frame-shape to be disposed outside a surface of the first contact member opposite the surface of the first contact member. The cap body includes first and second suction ports. The first suction port decompresses a first space formed between the first contact member and the ejection surface when the capping device contacts the ejection head. The second suction port decompresses a second space formed between the second contact member and the ejection surface when the capping device contacts the ejection head.

9 Claims, 7 Drawing Sheets

FLUID EJECTING APPARATUS

CROSS-REFERENCE TO RELATED APPLICATION

The entire disclosure of Japanese Patent Application No. 2008-123224, filed May 9, 2008 is expressly incorporated by reference herein.

BACKGROUND

1. Technical Field

The present invention relates to a fluid ejecting apparatus.

2. Related Art

Fluid ejecting apparatuses have ejection heads from which various types of fluid are ejected onto recording media or the like. Typical examples of fluid ejecting apparatuses are ink jet recording apparatuses having ink jet recording heads (hereinafter referred to simply as recording heads). Ink jet recording apparatuses perform recording by ejecting droplets of liquid ink (fluid) from nozzles in the recording heads (ejection heads), allowing the droplets land on recording media, and thereby forming dots on the recording media.

In the ink jet recording apparatuses, while ink is not being discharged, regions surrounding the nozzles are sealed so that ink in the nozzles does not dry. For example, Japanese Registered Utility Model No. 3125478 discloses a technology with which nozzles are sealed by pressing a cap against a recording head, applying suction to a film member with a negative pressure generated in the nozzles, and thereby making the film member closely contact a discharging surface of the recording head. However, with the technology disclosed in Japanese Registered Utility Model No. 3125478, a negative pressure has to be constantly generated in the nozzles so that the cap can seal the nozzles. There is another technology for preventing drying of ink in the nozzles by providing a frame-shaped sealing member (contact member) on an upper surface of a capping device, making the capping device contact a recording head, and thereby keeping the nozzles moist with the capping device.

However, for example, when the capping device is used for a long recording head, such as a line head, it is difficult to make the sealing member closely contact the entire area of the recording head because of deflection or the like that is generated in long components. Therefore, it may be difficult to make the capping device closely contact the recording head.

SUMMARY

An advantage of some aspects of the invention is that a fluid ejecting apparatus in which a capping device can be made to closely contact a recording head is provided.

A fluid ejecting apparatus according to an aspect of the invention includes an ejection head including an ejection surface having a nozzle region in which a plurality of nozzles for ejecting fluid are formed, and a capping device configured to contact the ejection surface of the ejection head. The capping device includes a first contact member, a second contact member, and a cap body holding the first contact member and the second contact member, the first contact member configured to contact the ejection surface such that a surface of the first contact member surrounds the nozzle region, and the second contact member formed in a closed frame-shape such that the second contact member is disposed outside a surface of the first contact member opposite the surface of the first contact member surrounding the nozzle region. The cap body includes a first suction port and a second suction port, the first suction port for decompressing, by suction, a first space formed between the first contact member and the ejection surface when the capping device contacts the ejection head, and the second suction port for decompressing, by suction, a second space formed between the second contact member and the ejection surface when the capping device contacts the ejection head.

With the fluid ejecting apparatus according to the aspect of the invention, the second suction port serves to make the second space enter a negative pressure state so that the cap body is attracted to the ejection surface, whereby a close contact load for pressing the first contact member against the ejection surface is generated. Thus, the capping device can be made to closely contact the recording head and the first space surrounded by the first contact member can be reliably made to enter a negative pressure state, and fluid can be drained from the nozzles in the nozzle region, so that a maintenance operation can be smoothly performed. Moreover, because the capping device is made to closely contact the recording head with the negative pressure, capping device can be pressed against the recording head with a small load in an initial stage of capping operation, so that creep deformation of the first contact member and the second contact member can be reduced.

It is preferable that, in the fluid ejecting apparatus, the second contact member surround the first contact member.

With this structure, because the second contact member surrounds the first contact member, a close contact load can be applied to the entire area of the first contact member. Thus, the first contact member can be made to closely contact the ejection surface of the ejection head with reliability.

It is preferable that a region of the cap body defined by the first contact member and the second contact member include an annular-like region having a long axis and a short axis, and the second suction port be disposed at an end in a long axis direction of the annular-like region.

With this structure, because a suction is performed on an end in a long axis direction of a long fluid ejection head such as a line head, a sufficient contact load is applied to the end of the head, so that the capping device can closely contact the head with reliability.

It is preferable that the hardness of the second contact member be lower than the hardness of the first contact member.

With this structure, the first contact member is prevented from being broken due to a contact load generated in the second space, so that the first space can be tightly closed with reliability. Thus, a suction force can be reliably applied to the nozzle region through the first suction port.

It is preferable that upper end portions of the first and second contact members be disposed in a plane parallel to the ejection surface.

With this structure, the first contact member and the second contact member can be made to contact the ejection surface without excessively pressing the cap body against the ejection head, so that the first space and the second space are tightly sealed with reliability. Thus, the first contact member can be made to closely contact the ejection surface with reliability by, for example, making the second space enter a negative pressure state.

It is preferable that the capping device include a suction device that applies a suction force to the first and second suction ports.

With this structure, because one suction device applies a suction force to the first and second suction ports, the structure of the fluid ejecting apparatus can be simplified.

It is preferable that the capping device includes a first suction device that applies a suction force to the first suction port and a second suction device that applies a suction force to the second suction port.

With this structure, a suction operation for draining ink from the nozzles and a contact operation for making the capping device closely contact the ejection head using the first and second suction devices can be separately controlled, so that operation of the capping device can be simply handled.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
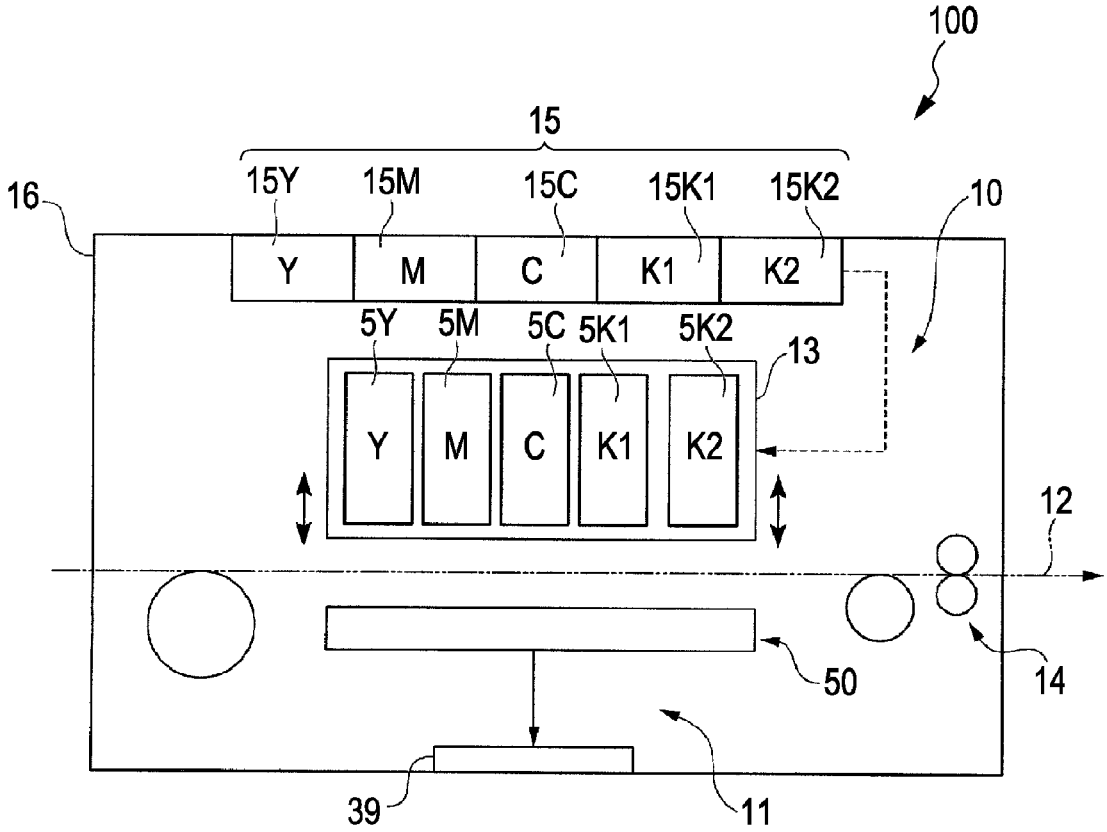
FIG. 1 is schematic view of a printer.

Hereinafter, a fluid ejecting apparatus according to an embodiment of the invention is described with reference to the drawings. As necessary, components of the apparatus are shown in different scales in the drawings so that the components can be recognized. In the present embodiment, an ink jet printer is described as an example of the fluid ejecting apparatus according to the invention.

Figure 2:
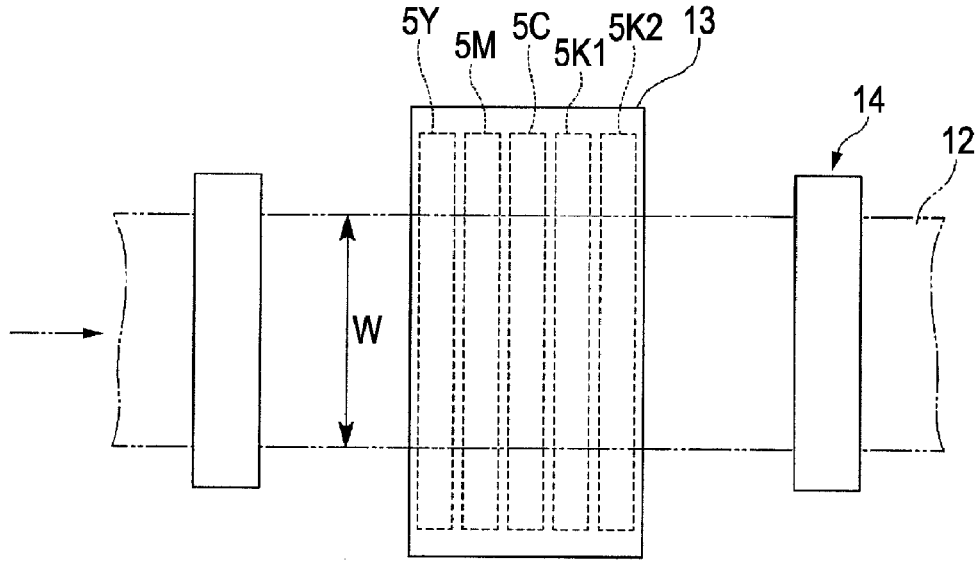
FIG. 2 is a plan view of a region surrounding a recording head.
Figure 3:
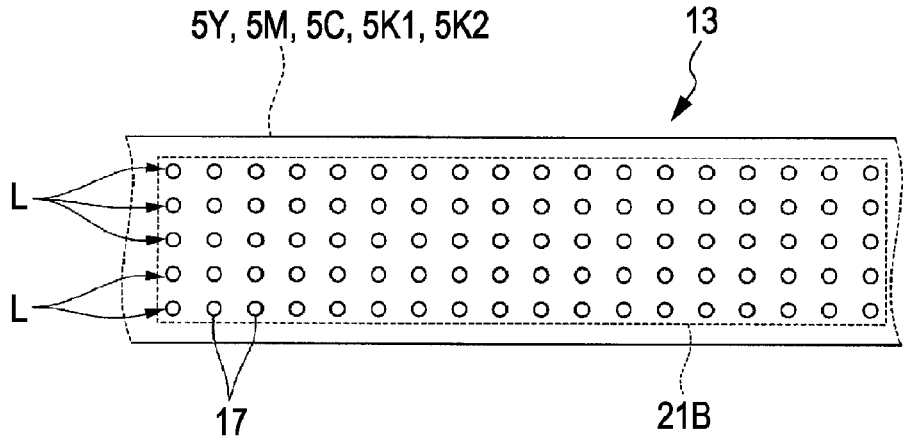
FIG. 3 is a plan view of an ejection surface of the recording head.

FIG. 1 is a schematic view of an ink jet printer (hereinafter, referred to as a printer 100) according to the present embodiment, FIG. 2 is a plan view of a region surrounding a recording head, and FIG. 3 is a plan view of an ejection surface of the recording head.

As shown in FIGS. 1 and 2, in the present embodiment, the printer 100 includes a recording section 10 that performs recording on a recording sheet 12 and a maintenance section 11 that performs a maintenance operation on the recording section 10.

The recording section 10 includes a recording head 13 (ejection head) that ejects ink droplets onto the recording sheet 12 so as to form an image on the recording sheet 12, a recording sheet transport mechanism 14 that transports the recording sheet 12, and an ink storage section 15 that stores ink (fluid) that is supplied to the recording head 13.

The maintenance section 11 includes a capping device 50 and a waste ink tank 39. The capping device 50 serves to prevent drying of ink in the nozzles and to perform a suction operation for draining ink that has thickened in the nozzles. The ink that has been drained by the capping device 50 is collected in the waste ink tank 39. A detailed structure of the capping device 50 is described below.

The recording sheet transport mechanism 14 includes a paper feed motor (not shown) and a paper feed roller rotated by the paper feed motor, so that the recording sheet 12 can be successively fed to a position facing the recording head 13 in synchronization with a recording (printing) operation.

The ink storage section 15, which is disposed on a side of a printer body 16, supplies ink to the recording head 13 (described below) by using ink supply means (not shown). The ink storage section 15 includes ink tanks 15Y, 15M, 15C, 15K1, and 15K2 corresponding to colors (yellow (Y), magenta (M), cyan (C), dye-type black (K1), and pigment-type black (K2)) used by the printer 100. The ink storage section 15 communicates with the recording head 13 through the ink supply means.

The recording head 13 is a so-called line-head-type recording head in which a large number of nozzles are arranged along a width (maximum recording sheet width W) that is larger than at least one of the sides of the recording sheet 12 of the largest size that can be used by the printer 100. In the present embodiment, the recording head 13 includes at least five print sections 5Y, 5M, 5C, 5K1, and 5K2 corresponding to the colors Y, M, C, K1, and K2. Each of the print sections 5Y, 5M, 5C, 5K1, and 5K2 has nozzle arrays L (see FIG. 3) in which a large numbers of nozzles 17 for ejecting ink droplets are arranged. The nozzle arrays L are formed in a nozzle region 21B. The nozzle arrays L are disposed along a transport direction of the recording sheet 12. The nozzle arrays L may include a single column of the nozzles 17 or a plurality of columns of the nozzles 17. The number of columns and the number of the nozzles 17 in each of the columns may be set as appropriate. FIG. 3 shows an embodiment of the nozzle arrays L, which includes a plurality of columns of the nozzles 17. By increasing the number of columns, recording can be simultaneously performed over a wide area and an image resolution can be increased.

The recording head 13 has a length corresponding to the maximum recording sheet width W. The recording head 13 is disposed such that the direction of the length is perpendicular to the transport direction of the recording sheet 12. Ink droplets are ejected onto the recording sheet 12 from the nozzles 17 of the nozzle arrays L so as to record an image on the recording sheet 12.

The ink supply means, through which the ink storage section 15 communicates with the recording head 13, includes a plurality of ink supply channels (not shown) so that ink can be supplied from the ink tanks 15Y, 15M, 15C, 15K1, and 15K2 to the print sections 5Y, 5M, 5C, 5K1, and 5K2.

Figure 4:
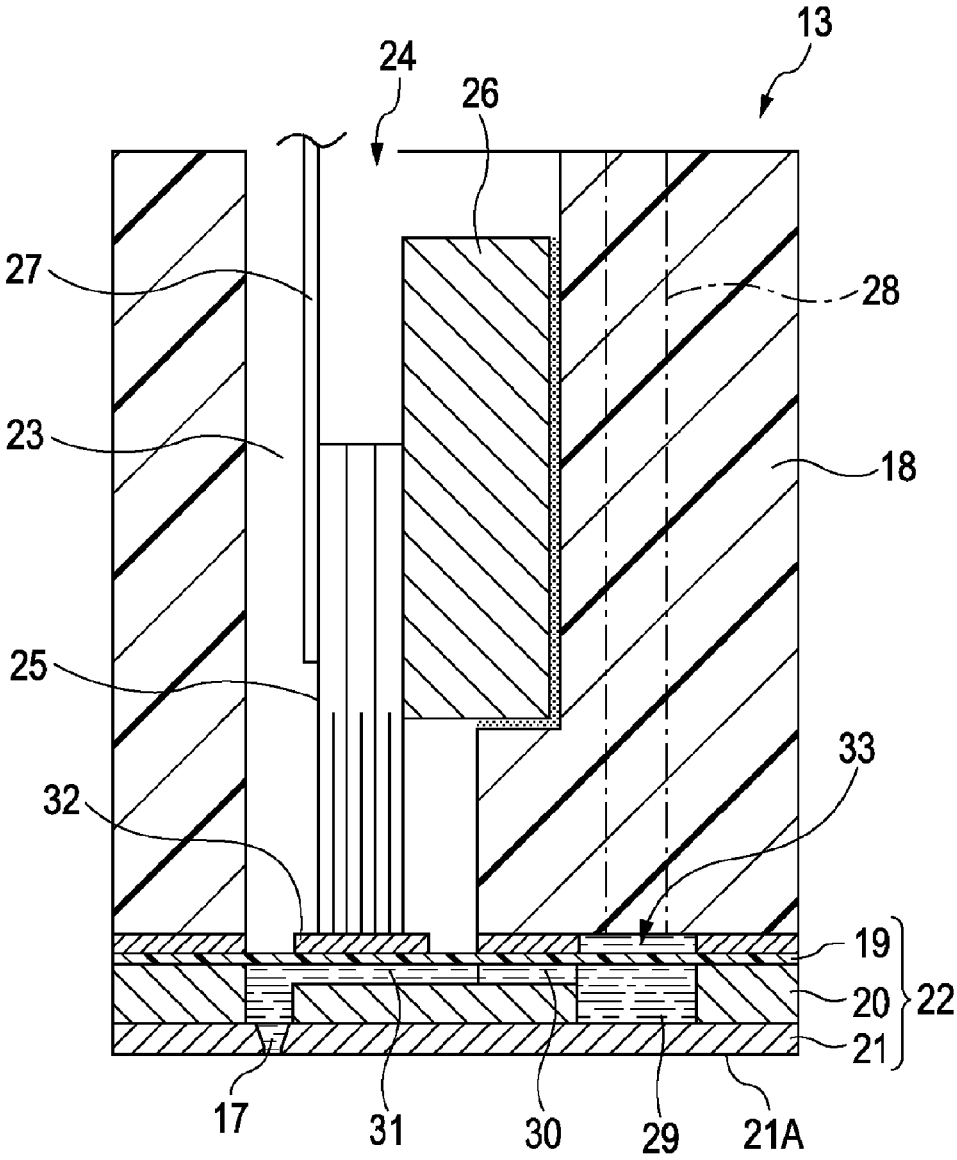
FIG. 4 is a sectional view of the recording head.

Referring to FIG. 4, the structure of the recording head 13 is described in detail below. FIG. 4 is a sectional view showing a portion of the recording head 13.

The recording head 13 has a head body 18 and a channel forming unit 22 that includes a diaphragm 19, a channel substrate 20, and a nozzle substrate 21. The nozzles 17, which eject ink, are formed in the nozzle substrate 21. A bottom surface of the nozzle substrate 21 is an ejection surface 21A. In the channel forming unit 22, the diaphragm 19, the channel substrate 20, and the nozzle substrate 21 are stacked and bonded to one another with an adhesive or the like.

The recording head 13 includes an accommodation space 23 formed in the head body 18 and a drive unit 24 disposed in the accommodation space 23. The drive unit 24 includes a plurality of piezoelectric elements 25 (fluid supply section), a fixing member 26 supporting an upper end of the piezoelectric elements 25, and a flexible cable 27 through which a drive signal is supplied to the piezoelectric elements 25. The piezoelectric elements 25 are disposed so as to correspond to each of the nozzles 17.

The recording head 13 includes an inner channel 28, the diaphragm 19, the channel substrate 20, a reservoir 29, an ink supply port 30, and cavities 31. The inner channel 28 is formed in the head body 18. Ink is supplied from the ink tank to the recording head 13 through the ink supply channel and flows through the inner channel 28. The reservoir 29 is formed by the channel forming unit 22 including the nozzle substrate 21 and connected to the inner channel 28. The ink supply port 30 is formed by the channel forming unit 22 and connected to the reservoir 29. The cavities 31 are formed by the channel forming unit 22 and connected to the ink supply port 30. The cavities 31 are formed so as to correspond the nozzles 17. Each of the nozzles 17 is connected to a corresponding one of the cavities 31.

The head body 18 is made of synthetic resin. The diaphragm 19, for example, has a support plate made of stainless steel or the like laminated with an elastic film. Island portions 32 are formed on the diaphragm 19 at positions corresponding to the cavities 31. The island portions 32 are connected to bottom ends of the piezoelectric elements 25. At least a portion of the diaphragm 19 elastically deforms in accordance with the movement of the piezoelectric elements 25. Between the diaphragm 19 and a vicinity of a bottom end of the inner channel 28, a compliance section 33 is formed.

The channel substrate 20 has the reservoir 29 that connects the bottom end of the inner channel 28 and the nozzles 17. The ink supply port 30 and the cavities 31 have recesses that form the inner spaces thereof. In the present embodiment, the channel substrate 20 is made by anisotropically etching silicon.

The nozzle substrate 21 has the nozzles 17 that are arranged in a specified direction with a specified distance (pitch) therebetween. The nozzle substrate 21 of the present embodiment is a plate-shaped member that is made, for example, of a metal such as stainless steel.

Ink is supplied from each of the ink tanks through a corresponding ink supply channel to the top end of the inner channel 28. The bottom end of the inner channel 28 is connected to the reservoir 29. The ink, which has flowed from the ink tanks through the ink supply channel to the top end of the inner channel 28, flows through the inner channel 28 and is supplied to the reservoir 29. The ink supplied to the reservoir 29 is allocated to each of the cavities 31 through the ink supply port 30.

When a drive signal is input through the flexible cable 27 to the piezoelectric element 25, the piezoelectric element 25 expands and contracts. Then, the diaphragm 19 deforms (displaces) in directions in which the diaphragm 19 approaches and retreats from the cavity 31. Thus, the volume of the cavity 31 varies, and the pressure of the cavity 31, which contains ink, fluctuates. This fluctuation of the pressure causes the ink to be ejected from the nozzle 17.

In this way, in the present embodiment, the piezoelectric element 25 causes the pressure of the cavity 31, which is connected to the nozzle 17, to fluctuate in accordance with the input drive signal so as to eject ink from the nozzles 17. The ink ejected from the nozzles 17 forms a desired image on the recording sheet 12.

The recording head 13 is configured to be movable in the vertical direction with a head moving mechanism (not shown). To be specific, the recording head 13 is configured to be movable with the head moving mechanism between a printing position and a maintenance position in the vertical direction.

The term "printing position" refers to a position at which the recording head 13 performs recording by ejecting ink from the nozzles 17 of the recording head 13 onto the recording sheet 12. This is a position at which the recording head 13 is displaced relatively upward. The term "maintenance position" refers to a position at which a maintenance operation on the recording head 13 is performed by the maintenance section 11, which is described in detail below. This is a position at which the recording head 13 is displaced relatively downward (see FIG. 1).

Figure 5:
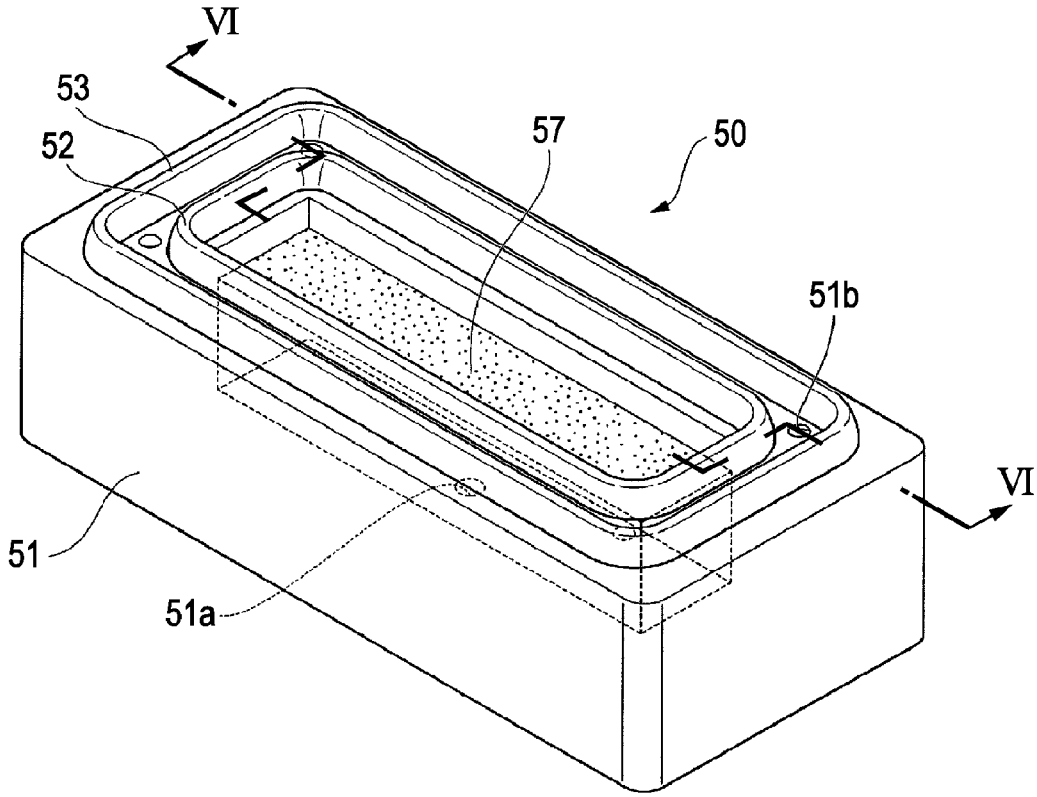
FIG. 5 is a perspective view showing a structure of a capping device.
Figure 6:
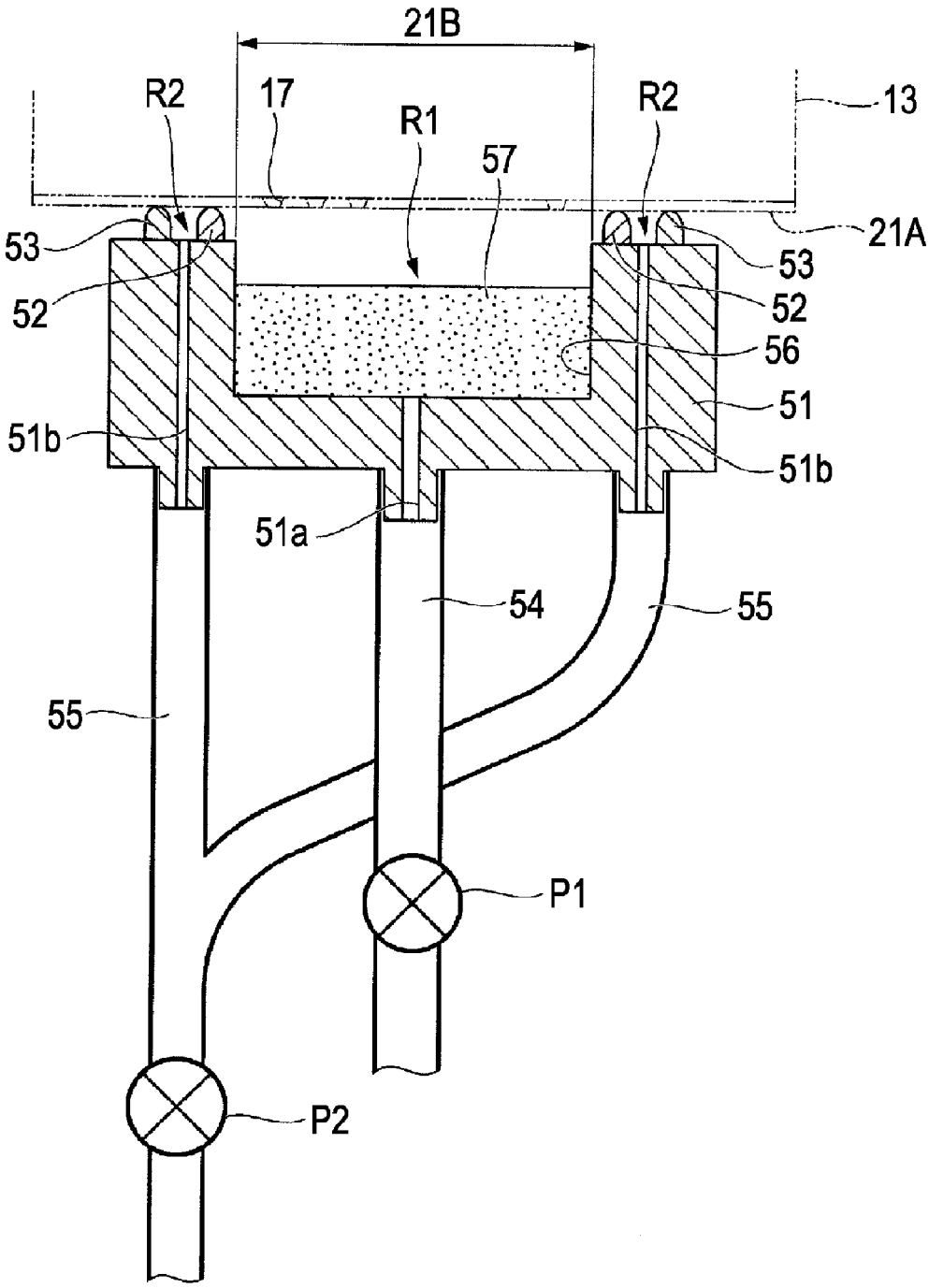
FIG. 6 is a sectional side view of the capping device taken along line VI-VI of FIG. 5.

FIG. 5 is a perspective view showing a structure of the capping device 50 in the maintenance section 11, and FIG. 6 is a sectional side view of the capping device 50 taken along line VI-VI of FIG. 5. As shown in FIGS. 5 and 6, the capping device 50 includes a cap body 51, a first contact member 52 and a second contact member 53 disposed on a surface of the cap body 51, and suction devices P1 and P2 connected to the cap body 51 through suction tubes 54 and 55.

The cap body 51 has a recess 56 in which an ink absorbing member 57 is disposed. The ink absorbing member 57 is made of a sponge member, a porous member, or the like that can hold (absorb) ink. The ink absorbing member 57 absorbs ink that is drained from the nozzles 17 by a suction operation using the capping device 50, which is described below, so as to prevent the ink from adhering to the ejection surface 21A.

The first contact member 52 and the second contact member 53 are configured to contact the ejection surface 21A of the recording head 13. To be specific, as shown in FIG. 6, the first contact member 52 contacts the ejection surface 21A such that a surface of the first contact member 52 surrounds the nozzle region 21B of the recording head 13. The nozzle region 21B is a region in which all the nozzles 17 in the ejection surface 21A of the recording head 13 are disposed.

The first contact member 52 is configured to contact a frame-shaped area extending along a periphery of the ejection surface 21A that is substantially rectangular in plan view. The second contact member 53 is formed in a closed frame shape and is disposed outside a surface of the first contact member 52 opposite the surface of the first contact member 52 surrounding the nozzle region 21B. To be specific, in the present embodiment, the second contact member 53 surrounds the first contact member 52. The first contact member 52 and the second contact member 53 have annular-like shapes having long axes and short axes. A region of the cap body 51 defined by the first contact member 52 and the second contact member 53 has an annular-like shape having a long axis and a short axis.

The term "first space R1" refers to a space that is formed between the first contact member 52 and the ejection surface 21A when the capping device 50 contacts the recording head 13, and the term "second space R2" refers to a space formed between the second contact member 53 and the ejection surface 21A when the capping device 50 contacts the recording head 13.

In the present embodiment, the first contact member 52 and the second contact member 53 have the same height relative to a surface of the cap body 51. That is, upper ends of the first contact member 52 and the second contact member 53 are disposed in a plane parallel to the surface of the ejection surface 21A. Thus, without applying excessive pressure to the cap body 51, the first contact member 52 and the second contact member 53 can contact the ejection surface 21A so that the first space R1 and the second space R2 are tightly sealed with reliability.

The first contact member 52 and the second contact member 53 are made of an elastic material such as an elastomer. The hardness of the second contact member 53 is lower than that of the first contact member 52. For example, the first contact member 52 has a hardness of 60° and the second contact member 53 has a hardness of 40° to 50°.

As shown in FIG. 5, the cap body 51 includes a first suction port 51*a* and a plurality of second suction ports 51*b*. The first suction port 51*a* serves to decompress the first space R1, which is formed between the first contact member 52 and the ejection surface 21A when the capping device 50 contacts the recording head 13, by suction. The second suction ports 51*b* serve to decompress the second space R2, which is formed between the second contact member 53 and the ejection surface 21A when the capping device 50 contacts the recording head 13, by suction.

The first suction port 51*a* is formed substantially at the center of the cap body 51 in plan view. The second suction ports 51*b* are disposed in the cap body 51 at end portions of the annular-like region having a long axis and a short axis, which is defined by the first contact member 52 and the second contact member 53. To be specific, the second suction ports 51*b* are disposed in four corners of the region defined by the first contact member 52 and the second contact member 53, the region having a substantially frame-like shape in plan view.

The first suction port 51*a* serves to decompress the first space R1 so that ink is drained from the nozzles 17. The second suction ports 51*b* serve to decompress the second space R2 so as to make the second space R2 enter a negative pressure state so as to generate a contact force with which the cap body 51 contacts the ejection surface 21A.

The first suction port 51*a* and the second suction ports 51*b* extend through the cap body 51 to the back surface (on the opposite side of the contact surface) of the cap body 51. An end of the suction tube 54 is connected to the first suction port 51*a*, and ends of the suction tubes 55 are connected to the second suction ports 51*b*. The other end of the suction tube 54 is connected to a first suction device P1, and the other ends of the suction tubes 55 are connected to a second suction device P2. The first and second suction devices P1 and P2 include, for example, suction pumps.

With this structure, the first suction device P1 performs a contact operation for making the capping device 50 contact the recording head 13, and the second suction device P2 performs a suction operation for draining ink from the nozzles 17. By controlling the operations separately, operation of the capping device 50 can be simply handled.

Hereinafter, an operation of a printer 1 having the above-described structure is described. In particular, maintenance operations including a suction operation are described in detail. The printer 1 may suffer from an ejection failure if ink thickens in the nozzles 17. In such a case, an ejection performance of the recording head 13 can be recovered by draining the ink from the nozzles 17 using the above-described capping device 50. The suction operation may be automatically performed at preset timings or at desired timings specified by a user.

To perform the suction operation, a controller (not shown) of the printer 1 moves the recording head 13 to a home position at which the recording head 13 faces the capping device 50. Then, the recording head 13 is lowered so that the ejection surface 21A of the recording head 13 contacts the first contact member 52 and the second contact member 53. At this time, because the upper end portions of the first contact member 52 and the second contact member 53 are disposed in a plane parallel to the ejection surface 21A, without excessively pressing the cap body 51, the first contact member 52 and the second contact member 53 contact the ejection surface 21A so that the first space R1 and the second space R2 are formed.

Then, the second suction device P2 is driven so that the second space R2 is decompressed through the second suction ports 51*b* and made to enter a negative pressure state. In the negative pressure state, the second space R2 generates a contact load that makes the cap body 51 closely contact the ejection surface 21A. The contact load presses the first contact member 52 so that the capping device 50 closely contacts the recording head 13.

Because the second contact member 53 surrounds the first contact member 52, the contact load can be applied to the entire area of the first contact member 52. Therefore, the first contact member 52 can closely contact the ejection surface 21A of the recording head 13 with reliability.

In the embodiment, the recording head 13 of the printer 1 is a so-called line head having a large length. It is generally difficult to make the capping device 50 closely contact end portions of the nozzle region 21B for a long recording head. However, the close contact load can be sufficiently generated even for the recording head 13 having a large length because the second suction ports 51*b* are formed in end portions (in plan view, four corners of the second space R2 having a substantially frame-like shape) of the nozzle region 21B so that the first contact member 52 can be pressed against the end portions of the nozzle region 21B (end portions of the recording head 13) and the capping device 50 can closely contact the recording head 13 with reliability.

When the capping device 50 has been made to closely contact the recording head 13, the second suction device P2 is driven so as to make the first space R1 enter a negative pressure state, so that ink is drained from the nozzles 17 to the first space R1. Using the capping device 50, a suction operation can be smoothly performed on the recording head 13 of a line head type.

Because the capping device 50 is made to closely contact the recording head 13 with the negative pressure, the capping device 50 can be pressed against the recording head 13 with a small load. As a result, the amount of creep deformation of the first and second contact members 52 and 53, which may be generated when the capping device 50 is pressed against the recording head 13, can be reduced.

Because the hardness of the second contact member 53 is lower than that of the first contact member 52, the first contact member 52 is prevented from being broken due to contact load generated by the second space R2, so that the first space R1 is tightly sealed with reliability. Thus, a suction force of first suction device P1 can be reliably applied to the first space R1 (nozzle region 21B) through the first suction port 51*a*.

Modification

A modification of the printer 1 is described below. In the above-described embodiment, the first suction port 51*a* (first space R1) of the cap body 51 is connected to the first suction device P1 and the second suction ports 51*b* (second space R2) are connected to the second suction device P2. However, as in this modification, one suction device may provide a suction force to the first space R1 and the second space R2.

Figure 7:
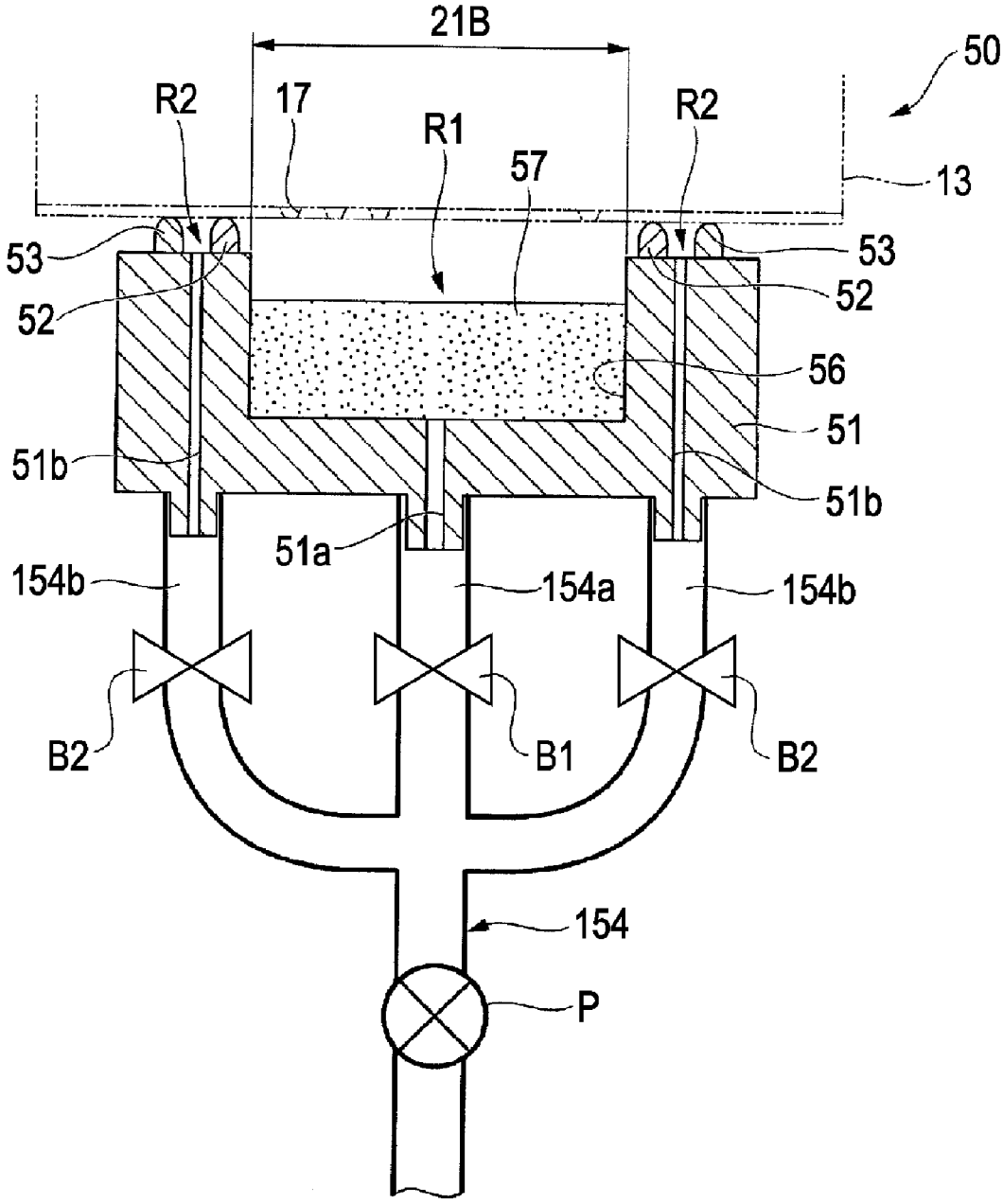
FIG. 7 is a sectional side view of a modification of the capping device.

FIG. 7 is a sectional side view of a modification of the capping device 50. As shown in FIG. 7, in the modification, one end of a suction tube 154 is connected, for example, to a suction device P including a suction pump. The other end of the suction tube 154 branches into one branch section 154*a* and two branch sections 154*b*. The branch section 154*a* is connected to the first suction port 51*a*, and the branch sections 154*b* are connected to the second suction ports 51*b*. The branch section 154*a* has a valve B1 and the branch sections 154*b* have valves B2 for opening and closing inner channels.

A suction operation using the capping device 50, which is performed by the printer 1 according to the modification, is described.

As in the above-described embodiment, to perform the suction operation, the recording head 13 is lowered so that the first contact member 52 and the second contact member 53 contact the ejection surface 21A of the recording head 13.

Before the suction device P is driven, the valve B1 in the branch section 154*a* of the suction tube 154 is closed, and the valves B2 in the branch sections 154*b* are opened. In this state, the suction device P is driven. At this time, a suction force of the suction device P is applied only to the second suction ports 51*b* through the branch sections 154*b*, so that the second space R2 is decompressed and made to enter a negative pressure state. The second space R2 in the negative pressure state generates a contact load that makes the cap body 51 closely contact the ejection surface 21A. Thus, the first contact member 52 is pressed so that the capping device 50 closely contacts the recording head 13.

After the capping device 50 has been made to closely contact the recording head 13 and before the suction operation with the suction device P starts, the valve B1 in the branch section 154*a* of the suction tube 154 is opened and the valves B2 in the branch sections 154*b* of the suction tube 154 are closed. Thus, the second space R2 is held in a negative pressure state.

In this state, the suction device P is driven. At this time, the suction force of the suction device P is applied only to the first suction port 51*a* through the branch section 154*a*. Therefore, the suction operation, with which the first space R1 is made to enter a negative pressure state so that ink is drained through the nozzles 17 to the first space R1 in the negative pressure state, can be smoothly performed.

The invention is not limited to the above-described embodiment and modification. Various modifications may be made in accordance with the spirit and scope of the invention.

Figure 8:
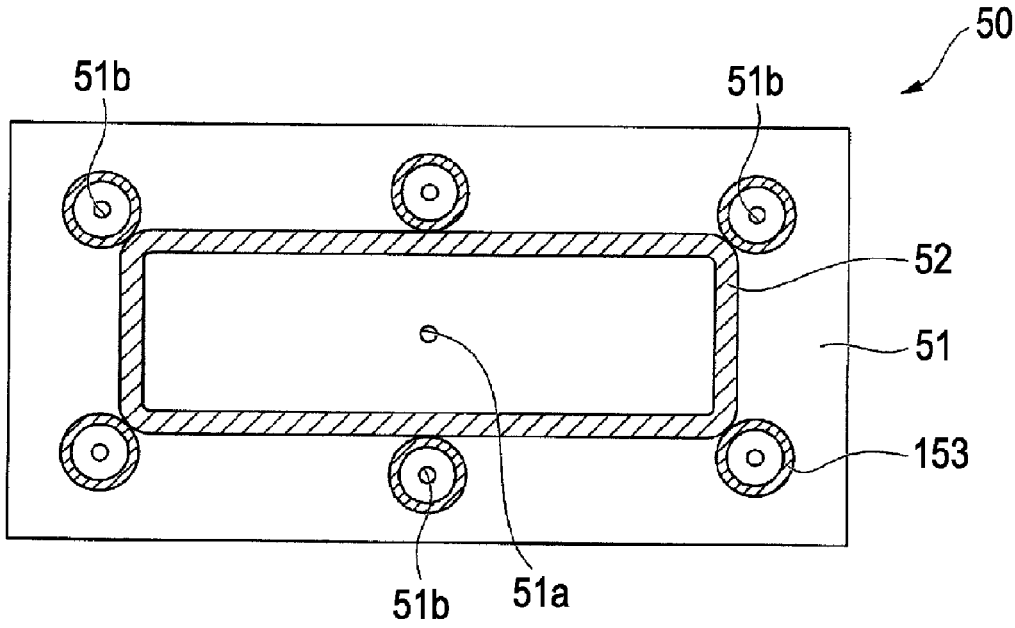
FIG. 8 is a view of a second contact member having another structure.
Figure 9:
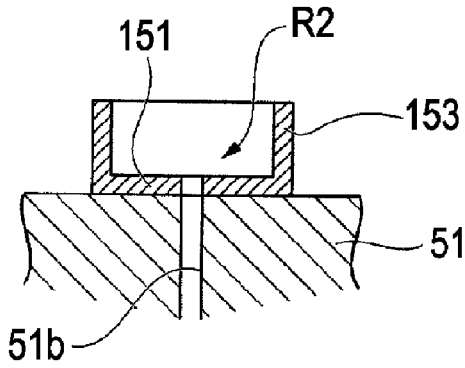
FIG. 9 is a view of a modification of the second contact member shown in FIG. 8.

For example, although the second contact member 53 surrounds the first contact member 52 in the above-described embodiment, the shape of the first contact member 52 is not limited to such a shape. For example, as shown in FIG. 8, a plurality of second contact members 153 in closed annular shapes may be disposed outside a surface of the first contact member 52 opposite the surface of the first contact member 52 surrounding the nozzle region 21B. In this case, the second suction ports 51*b* are each formed in a region surrounded by one of the second contact members 153. With this structure, a plurality of second spaces R2 can be formed by the second contact members 153 and the ejection surface 21A. As shown in FIG. 8, by evenly disposing second spaces R2, which generate the contact loads described above, around the first contact member 52, the first contact member 52 can closely contact the ejection surface 21A. Moreover, as shown in FIG. 9, ribs 151 may be formed at the bottom of the second contact members 153. With this structure, the mechanical strength of the second contact members 153 can be increased, and the volumes of the second spaces R2 formed between the second contact members 153 and the ejection surface 21A can be reduced as compared with the structure shown in FIG. 8. Therefore, the second space R2 can be decompressed within a short time, so that the capping device 50 can be effectively made to contact the recording head 13.

In the above-described embodiment, the fluid ejecting apparatus is embodied in the ink jet printer. However, the fluid ejecting apparatus may be embodied in an apparatus for ejecting or discharging fluid other than ink (a liquid-like material in which particles of a functional material are dispersed or a gel-like fluid).

For example, the fluid ejecting apparatus may be an apparatus for ejecting a liquid, in which an electrode material or a color material is dispersed or dissolved, that is used for making liquid crystal displays, electroluminescence display, a surface emission display or the like; an apparatus for ejecting a bioorganic material for making biochips; or an apparatus for ejecting sample fluid and is used as a precision pipette.

Furthermore, the fluid ejecting apparatus may be an apparatus for precisely ejecting lubricant to a precision machinery such as a watch or a camera, an apparatus for ejecting transparent liquid resin such as UV curable resin that is used for making a small hemispherical lens (optical lens) for an optical communication device or the like, an apparatus for ejecting etching liquid such as an acid or an alkali for etching a substrate or the like, or an apparatus for ejecting gel.

What is claimed is:

1. A fluid ejecting apparatus comprising:

an ejection head including an ejection surface having a nozzle region in which a plurality of nozzles for ejecting fluid are formed; and a capping device configured to contact the ejection surface of the ejection head, wherein the capping device includes a first contact member, a second contact member, and a cap body holding the first contact member and the second contact member, the first contact member configured to contact the ejection surface such that a surface of the first contact member surrounds the nozzle region, and the second contact member being formed in a closed frame-shape such that the second contact member is disposed outside a surface of the first contact member opposite the surface of the first contact member surrounding the nozzle region, and wherein the cap body includes a first suction port and a second suction port, the first suction port for decompressing, by suction, a first space formed between the first contact member and the ejection surface when the capping device contacts the ejection head, the first space surrounding the plurality of nozzles such that suction provided by the first suction port is configured to suck ink from plurality of nozzles when the capping device contacts the ejection head, and the second suction port for decompressing, by suction, a second space formed between the second contact member and the ejection surface so as to cause the second space to enter a negative pressure state that generates a contact force between the cap body and the ejection surface while not sucking any ink when the capping device contacts the ejection head.

2. The fluid ejecting apparatus according to claim 1, wherein the second contact member surrounds the first contact member.

3. The fluid ejecting apparatus according to claim 2, wherein a region of the cap body defined by the first contact member and the second contact member includes an annular-like region having a long axis and a short axis, and the second suction port is disposed at an end in a long axis direction of the annular-like region.

4. The fluid ejecting apparatus according to claim 2, wherein a hardness of the second contact member is lower than a hardness of the first contact member.

5. The fluid ejecting apparatus according to claim 1, wherein upper end portions of the first and second contact members are disposed in a plane parallel to the ejection surface.

6. The fluid ejecting apparatus according to claim 1, wherein the capping device includes a suction device that applies a suction force to the first and second suction ports.

7. The fluid ejecting apparatus according to claim 1, wherein the capping device includes a first suction device that applies a suction force to the first suction port and a second suction device that applies a suction force to the second suction port.

8. The fluid ejecting apparatus according to claim 1, wherein the first contact member and the second contact member have the same height relative to a surface of the cap body.

9. The fluid ejecting apparatus according to claim 1, wherein the first suction port is formed substantially in the center of the cap body.

* * * * *